US006006962A

United States Patent [19]

Ebeling, II

[11] Patent Number: 6,006,962

[45] Date of Patent: Dec. 28, 1999

[54] TOOL FOR FORMING POCKETS IN BASEBALL AND SOFTBALL GLOVES

[76] Inventor: John J. Ebeling, II, 1360 S. 5th St. Suite 214, St. Charles, Mo. 63301

[ * ] Notice: Under 35 U.S.C. 154(b), the term of this patent shall be extended for 635 days.

[21] Appl. No.: 08/688,141

[22] Filed: Jul. 29, 1996

Related U.S. Application Data

[60] Continuation of application No. 08/398,000, Mar. 3, 1995, abandoned, which is a division of application No. 08/059, 185, May 6, 1993, Pat. No. 5,421,493.

[51] Int. Cl.[6] ..... A63B 67/00

[52] U.S. Cl. ..... 223/78; 273/25

[58] Field of Search ..... 223/78; 273/67 R, 273/84 R, 25, 72; 2/19; 81/28; 241/199, 169.2; 68/215; 452/146; 84/294.1

[56] References Cited

U.S. PATENT DOCUMENTS

| | | | |
|---|---|---|---|
| D. 151,599 | 11/1948 | Colm | D21/65 |
| D. 151,600 | 11/1948 | Colm | D21/65 |
| 278,575 | 5/1883 | Maris | 241/199 |
| 870,087 | 11/1907 | Dickens | 241/199 |
| 874,756 | 12/1907 | French | 241/199 |
| 1,049,649 | 1/1913 | Benjamin | 81/28 |
| 1,121,189 | 12/1914 | Lincoln | 273/72 R |
| 1,165,216 | 12/1915 | Weflen | 273/84 |
| 1,334,188 | 3/1920 | Swan | 273/84 R |
| 2,121,989 | 1/1938 | Schnase et al. | 273/84 R |
| 2,658,421 | 11/1953 | Clayton | 84/422 |
| 2,791,930 | 5/1957 | Soderberg | 84/422 |
| 2,896,492 | 7/1959 | Dane | 84/422 |
| 3,169,019 | 2/1965 | Genjack | 273/323 |
| 3,598,410 | 8/1971 | Costopoulos | 273/72 R |
| 4,454,204 | 6/1984 | Posey | 428/542.4 |

FOREIGN PATENT DOCUMENTS

| | | | |
|---|---|---|---|
| 554 | 12/1898 | United Kingdom | 273/84 |

OTHER PUBLICATIONS

"Bat Reinforced by Poly–Belting" *The Sporting Goods Dealer Magazine*, p. 135, Dec. 1971.

*Primary Examiner*—Bibhu Mohanty
*Attorney, Agent, or Firm*—Henry W. Cummings

[57] ABSTRACT

A method and apparatus is described to break in new and old softball and baseball gloves. A glove tool includes a head portion for pounding into the glove pocket and a handle portion for holding the tool. An enlogated body portion joins the handle portion to the head portion. The head portion, handle portion, and body portion may be formed seperately and connected together with mechanical fasteners. In the preferred embodiment, the tool is an intergal piece with the head portion, body portion, and handle portion formed as a single unitary tool.

4 Claims, 2 Drawing Sheets

TOOL FOR FORMING POCKETS IN BASEBALL AND SOFTBALL GLOVES

This application is a continuation of application Ser. No. 08/398,000, filed Mar. 3, 1995, now abandoned.

This application is a division of application Ser. No. 08/059,185 filed May 6, 1993.

BACKGROUND OF THE INVENTION

The object of the invention is to break in and maintain new and used softball and baseball gloves.

In U.S. Pat. No. 4,765,519 a pocket retaining and forming a device includes a strap which has a mid portion to which is attached a ball-like object. The end portions of the strap are connected together with Velcro fasteners to hold the ball-like member in place within the glove pocket. Softballs or baseballs may be attached to the strap.

A similar device is shown in U.S. Pat. No. 5,000,317. In this device, a ball-like member is held in place within the glove by means of a strap extending through a buckle.

In each of these devices, the pocket is formed and maintained merely by having a ball-shaped member held in place within the glove by the strap.

In U.S. Pat. No. 4,877,162 a device including three enlogated arms having a juncture points inserted into the glove. These arms are pliable and can be bent to a desired glove configuration. A wire chord in each arm is provided to retain whatever shape it is bent to.

Again, this is a device to be located within the glove and is designed to bend the glove while the device is in place within the glove.

SUMMARY OF THE INVENTION

A pocket forming tool is provided to break-in new and used baseball and softball gloves comprising an enlarged head portion to be used to form the pocket in the glove, a handle portion at an opposite end of the tool, which is also enlarged, and is connected to the head portion by an elongated body portion.

The method of treating the glove comprises pounding the head portion into the glove's existing pocket with a repeated action which mimicks the normal affect of a thrown ball entering and shaping the glove. Preferably glove dressing is also utilized during the process, which facilitates formation of the pocket in a more rapid manner.

THE DRAWINGS

DESCRIPTION OF PREFERRED EMBODIMENTS

Figure 2:
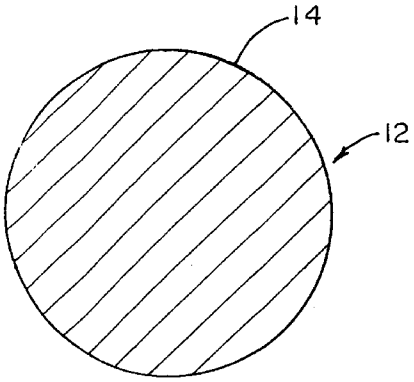
FIG. 2 is a sectional view looking in the direction of the arrows along the line 2—2 in FIG. 1.

The glove tool is illustrated in the drawings generally at 10 and includes a head portion 12 adapted to be pounded into the glove to improve the pocket. The head portion 12 is enlarged as indicated at 14 and may be generally circular in cross-section as shown in FIG. 2 and may have a radius of from about 1 to 2 inches.

Figure 1:
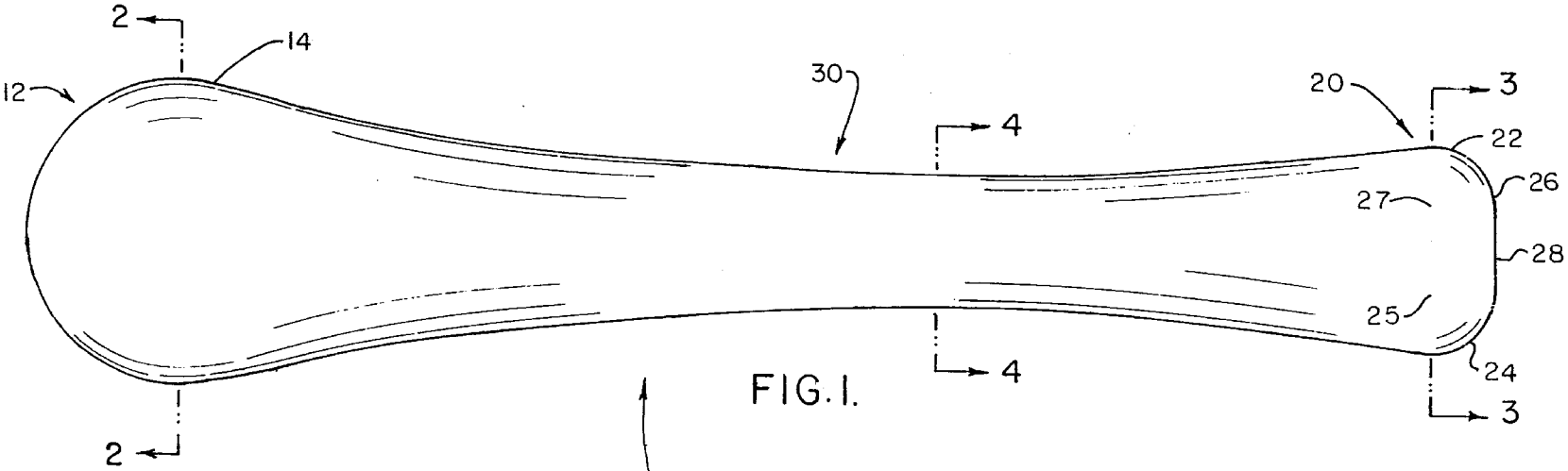
FIG. 1 is a side elevation view of the pocket tool of the present invention.
Figure 3:
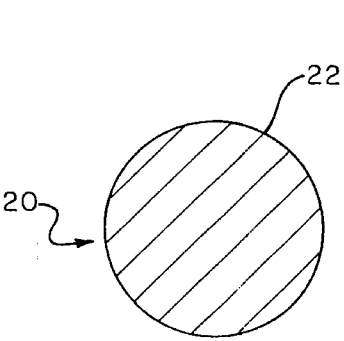
FIG. 3 is a sectional view looking in the direction of the arrows along the line 3—3 in FIG. 1.

The handle portion is indicated at 20 and the handle portion is also enlarged as indicated at 22. As shown in FIG. 3, it may also may be generally circular in cross-section and may have a radius of from about ½ inch to 1½ inches.

The handle portion further includes arcuate end portions indicated at 24 and 26, and a flat portion 28. End portions 24 and 26 have a smaller radius and may vary from about ¼ inch to ⅝ inch in radius. Arcuate portions 24 and 26 have respective centers of radius at 25 and 27.

Figure 5:
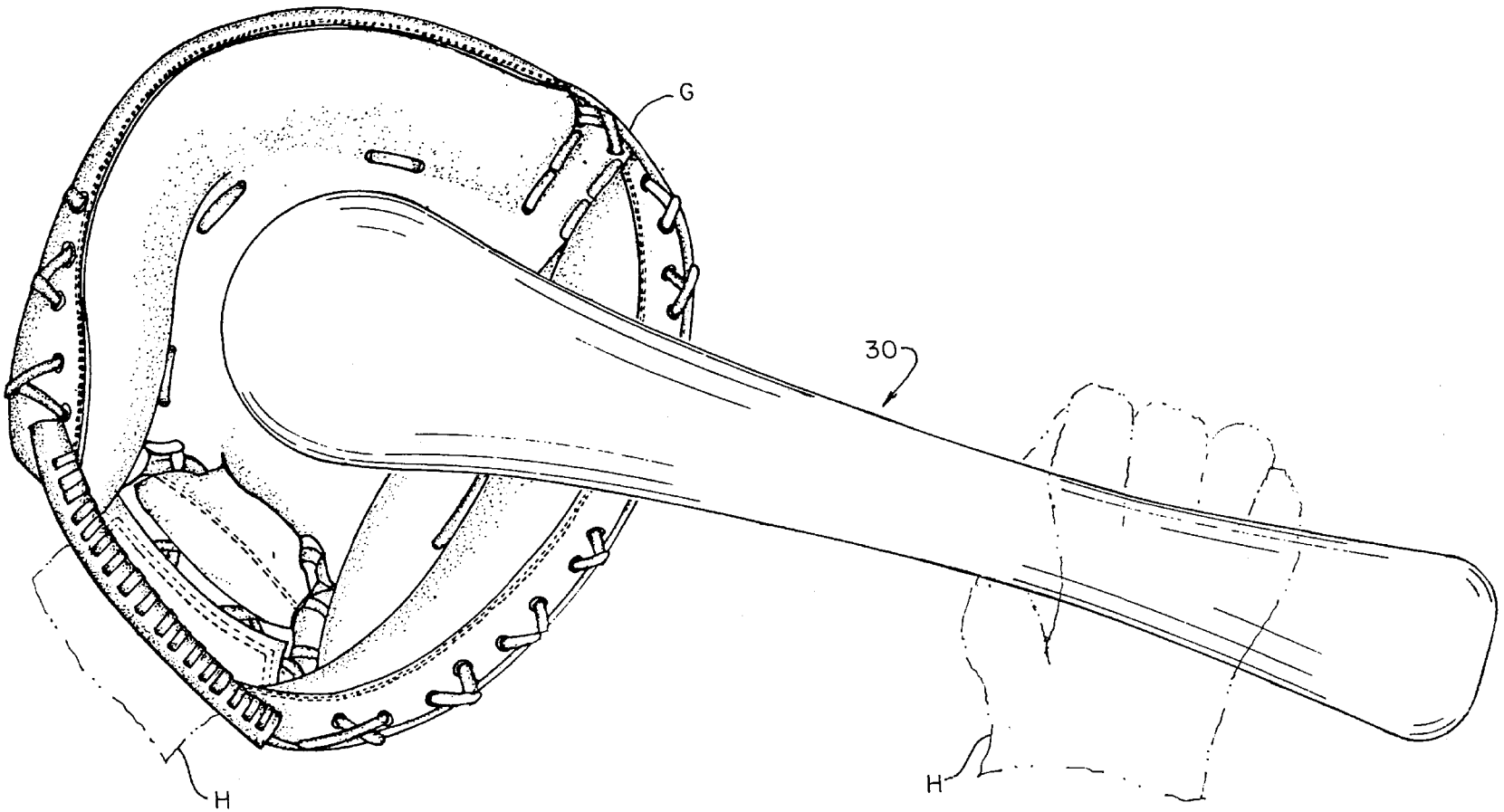
FIG. 5 is a perspective view illustrating using the tool to shape the pocket in the glove.

As shown in FIG. 5, the handle portion 20 is grasped by the operator, and the head portion 12 is pounded into the glove pocket.

Figure 4:
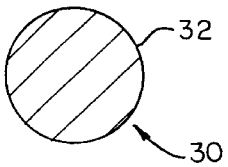
FIG. 4 is a sectional view looking in the direction of the arrows along the line 4—4 in FIG. 1.

The head portion 12 is joined to the handle portion 20 by a body portion 30. The body portion 30 is also conveniently circular as indicated in FIG. 4 at 32. The body portion provides leverage or a moment arm whereby when the operator grasps the handle portion 20 there is a sufficient moment arm whereby when the head portion 12 is pounded into the pocket a substantial amount of momentum is transferred into the pocket. To achieve this moment arm the overall lengthen of the device is preferable from about 10 to about 18 inches with the body portion constituting about 6 to 14 inches. It will be apparent that there is not a distinct dividing line between the body portion 30 and the head portion 12 and 20.

The tool may be made of any material which is relatively rigid, is non-corrosive to leather and leather substitutes used to make the glove, and which is generally inexpensive. Suitable materials include wood plastic and metal. In addition, the tool should be made of a material which is not too heavy. Thus in considering metals, aluminum, aluminum alloys and steel would be preferred over heavy metals such as lead.

The device may be formed by casting, molding, or machining from a blank. The head portion, handle portion, and body portion may be separately formed and then assembled into a unitary tool with mechanical fasteners, or by welding.

Compared to a conventional baseball bat, the tool of the present invention is considerably shorter and lighter. The head of a baseball bat is cylindrical. The head portion of the tool is spherical. The tool is too short for a baseball player to use as a bat, and a conventional baseball bat is too long, and the head portion too bulky to use as pocket forming tool.

Conventional glove dressing materials include linseed oil, Glovulum Trade mark of Rawlings Inc., which are applied prior to forming the pocket in order to soften and condition the leather of the glove.

In the use of the tool, the glove to be treated is placed in one hand, and the tool is held by the operator with his or her other hand grasping the handle portion (20, and rotating the tool with the handle portion (20) to pound the head portion (12) into the glove pocket, until the pocket is formed into desired contour.

What is claimed is:

1. A baseball or softball glove pocket forming tool comprised from a material selected from wood, plastic or metal in one single continuous piece having an enlarged head portion having an essentially spherical surface with essentially no flat portions located on a first end of the tool having a radius from about 1 to 2 inches, and being adapted to be pounded into a baseball or softball glove;

a handle portion at the opposite end of the device having an enclosed external surface also being enlarged having a radius of from about 0.5 to 1.5 inches, and adapted to be grasped by and operator to hold the tool as it used to form the pocket; and an elongated body portion having a radius of from about ¼ to about ¾ inches, extending between said head portion and said handle portion; said tool having sufficient length from about 10 to about 18 inches to enable a moment arm to be developed from the handle portion to the head portion, wherein when the head portion is pounded into the pocket a substantial amount of momentum is transferred into the pocket to form an improved pocket for grasping a baseball or softball.

2. A tool according to claim 1, wherein the head portion is substantially circular in cross section.

3. A tool according to claim 2, wherein the handle portion is substantially circular in cross section.

4. A tool according to claim 3, wherein the body portion is substantially circular in cross section.

* * * * *